US007261088B2

(12) United States Patent
Ciampolini

(10) Patent No.: US 7,261,088 B2
(45) Date of Patent: Aug. 28, 2007

(54) INTERNAL COMBUSTION ENGINE HYDRAULIC FUEL PUMP

(75) Inventor: Franco Ciampolini, Bologna (IT)

(73) Assignee: Magneti Marelli Holding S.p.A. (IT)

( * ) Notice: Subject to any disclaimer, the term of this patent is extended or adjusted under 35 U.S.C. 154(b) by 44 days.

(21) Appl. No.: 11/191,239

(22) Filed: Jul. 28, 2005

(65) Prior Publication Data

US 2006/0021599 A1 Feb. 2, 2006

(30) Foreign Application Priority Data

Jul. 30, 2004 (IT) ..... BO2004A0485

(51) Int. Cl.
*F02M 57/02* (2006.01)

(52) U.S. Cl. ..... 123/446; 417/393

(58) Field of Classification Search ..... None
See application file for complete search history.

(56) References Cited

U.S. PATENT DOCUMENTS 5,197,418 A * 3/1993 Wissmann et al. ..... 123/73 C
5,279,504 A * 1/1994 Williams ..... 417/393
5,365,893 A * 11/1994 Wissmann et al. ..... 123/73 C
5,735,250 A 4/1998 Rembold et al.
5,740,782 A 4/1998 Lowi, Jr.
6,162,028 A * 12/2000 Rembold ..... 417/413.1
6,280,149 B1 * 8/2001 Able et al. ..... 417/63
6,286,469 B1 * 9/2001 Cobb, Jr. ..... 123/73 C
6,663,360 B1 12/2003 Kyer

FOREIGN PATENT DOCUMENTS

CH 683 447 A 3/1994

* cited by examiner

*Primary Examiner*—Thomas Moulis
(74) *Attorney, Agent, or Firm*—Berenato, White & Stavish

(57) ABSTRACT

An internal combustion engine fuel pump having at least one cylinder, in which a variable-volume pump chamber is defined; a movable piston defining the bottom of the pump chamber; at least one intake valve communicating with the pump chamber; at least one delivery valve communicating with the pump chamber; and a hydraulic/pneumatic actuating device for moving the piston back and forth with respect to the cylinder to cyclically vary the volume of the pump chamber; the hydraulic/pneumatic actuating device has a first actuating chamber located beneath the pump chamber, a second actuating chamber located above the first actuating chamber, and a control member for cyclically filling the first actuating chamber with pressurized oil.

12 Claims, 3 Drawing Sheets

INTERNAL COMBUSTION ENGINE HYDRAULIC FUEL PUMP

The present invention relates to an internal combustion engine fuel pump.

The fuel pump according to the present invention may be used to advantage as a high-pressure fuel pump in a common-rail direct fuel injection system, to which the following description refers purely by way of example. cl BACKGROUND OF THE INVENTION In currently used common-rail direct fuel injection systems, a low-pressure pump feeds fuel from a tank to a high-pressure pump, which in turn feeds the fuel to a common rail; and a number of injectors are connected to the common rail and controlled cyclically to inject part of the pressurized fuel in the common rail into respective cylinders. The high-pressure pump comprises at least one cylinder with a piston controlled mechanically by the drive shaft to slide back and forth inside the cylinder; a one-way intake valve permitting fuel flow into the cylinder along an intake channel; and a one-way delivery valve connected to a delivery channel terminating inside the common rail, and permitting fuel flow from the cylinder.

For the injection system to function properly, it is important that a desired fuel pressure, which normally varies with time, be maintained at all times in the common rail. For this reason, the high-pressure pump is designed to supply the common rail, in any operating condition, with more fuel than is actually consumed, and a pressure regulator is connected to the common rail to maintain the desired fuel pressure inside the common rail by draining the surplus fuel into a recirculating channel, which feeds the surplus fuel back to a point upstream from the low-pressure pump.

Known injection systems of the above type have various drawbacks, on account of the high-pressure pump necessarily being designed to supply the common rail with slightly more fuel than can possibly be consumed in the maximum consumption condition. Since the maximum consumption condition, however, occurs fairly rarely, this means that in all other operating conditions, the high-pressure pump supplies the common rail with much more fuel than is actually consumed, and large part of the fuel must be drained by the pressure regulator into the recirculating channel. Since the work performed by the high-pressure pump, to pump fuel which is ultimately drained by the pressure regulator, is clearly "superfluous", the energy efficiency of injection systems of the above type is extremely low. Moreover, known injection systems of the above type tend to overheat the fuel. That is, when drained by the pressure regulator into the recirculating channel, the surplus fuel passes from a very high pressure to substantially atmospheric pressure, and as a result tends to heat. Finally, known injection systems of the above type are fairly bulky, on account of the pressure regulator and the recirculating channel connected to it.

To solve the above problems, it has been proposed, as described in Patent Application EP-0481964-A1, to employ a variable-delivery high-pressure pump designed to only supply the common rail with the amount of fuel necessary to maintain the desired fuel pressure inside the common rail. More specifically, the high-pressure pump comprises an electromagnetic actuator for instantaneously adjusting delivery of the high-pressure pump by adjusting the instant the high-pressure pump intake valve closes.

Another embodiment of a variable-delivery high-pressure pump is described in patent U.S. Pat. No. 6,116,870-A1, in which the high-pressure pump comprises a regulating device connected to the intake valve to keep the intake valve open during the compression stroke of the piston, and so permit fuel flow from the cylinder along the intake channel. The intake valve comprises a valve body movable along the intake channel; and a valve seat, which is engaged in fluidtight manner by the valve body, and is located at the opposite end of the intake channel to the end communicating with the cylinder. The regulating device comprises a control member connected to the valve body and movable between a passive position, in which it allows the valve body to engage the valve seat in fluidtight manner, and an active position, in which it prevents the valve body from engaging the valve seat in fluidtight manner; and an electromagnetic actuator is connected to the control member to move the control member between the passive and active positions.

As stated, in variable-delivery high-pressure pumps of the above type, delivery is adjusted by adjusting the instant the high-pressure pump intake valve closes. More specifically, delivery is reduced by delaying the instant the intake valve closes, and is increased by advancing the instant the intake valve closes.

Variable-delivery high-pressure pumps of the above type normally have two cylinders, along each of which a piston slides to perform one cycle for every two rotations of the drive shaft, so that, for every two complete rotations of the drive shaft, the high-pressure pump performs two pump strokes. In a four-stroke four-cylinder internal combustion engine, for each complete rotation of the drive shaft, the high-pressure pump performs one pump stroke, and fuel is injected by two injectors. When delivery equal or close to maximum delivery of the pump is demanded, both the injectors injecting fuel during the same rotation of the drive shaft inject fuel while one of the high-pressure pump pistons is pumping fuel into the common rail. When less than maximum delivery of the high-pressure pump is demanded, the pump stroke is divided, so that a first of the injectors injecting fuel during the same rotation of the drive shaft injects fuel while neither of the high-pressure pump pistons is pumping fuel into the common rail, and a second of the injectors injecting fuel during the same rotation of the drive shaft injects fuel while one of the high-pressure pump pistons is pumping fuel into the common rail. The resulting disparity between the two injectors injecting fuel during the same rotation of the drive shaft produces, for a given injection time, a difference in the amount of fuel injected by the two injectors, which obviously affects correct performance of the engine. Moreover, the difference is not always constant, and is substantial when the delivery demanded of the high-pressure pump is below a given threshold value corresponding to the value at which division of the pump stroke of the high-pressure pump coincides with the start of injection by the first of the two injectors injecting fuel during the same rotation of the drive shaft.

To at least partly eliminate the above drawback, it has been proposed to use a variable-delivery high-pressure pump having two cylinders, along each of which a piston slides to perform one cycle (i.e. one intake stroke and one pump stroke) for each rotation of the drive shaft. In a four-stroke four-cylinder internal combustion engine, therefore, for each complete rotation of the drive shaft, the high-pressure pump performs two pump strokes, and fuel is injected by two injectors. In this way, one of the injectors only ever performs one injection for each pump stroke of the high-pressure pump. When delivery equal or close to maximum delivery of the pump is demanded, all the injectors inject fuel while one of the high-pressure pump pistons is pumping fuel into the common rail. When less than maximum delivery of the high-pressure pump is demanded, the pump stroke is divided, and all the injectors inject fuel while neither of the high-pressure pump pistons is pumping fuel into the common rail. This obviously reduces the disparity in performance of the injectors, in that, within the same control interval, the injectors either all inject fuel while one of the high-pressure pump pistons is pumping fuel into the common rail, or all inject fuel while neither of the high-pressure pump pistons is pumping fuel into the common rail. A difference in performance, however, still remains to a certain extent, in that, in some control intervals, the injectors have certain dynamic characteristics, by injecting fuel while one of the high-pressure pump pistons is pumping fuel into the common rail, whereas, in other control intervals, the injectors have different dynamic characteristics, by injecting fuel while neither of the high-pressure pump pistons is pumping fuel into the common rail.

Moreover, the fact that the high-pressure pump pistons perform one cycle (i.e. one intake stroke and one pump stroke) for each rotation, as opposed to every two rotations, of the drive shaft, means doubling average piston speed, thus resulting in obvious problems in terms of mechanical strength and long-term reliability. Alternatively, it has been proposed to use high-pressure pumps comprising four cylinders and, hence, four pistons, each of which performs one cycle for every two rotations of the drive shaft. Though simpler to produce, this solution greatly increases the cost and size of the high-pressure pump.

In addition, known fuel pumps of the type described above are complicated and expensive to produce, by having to control the control member delaying the instant the intake valve closes; and fuel flows continuously through the intake valve to and from the cylinder, thus obviously wasting part of the energy used by the pump. Finally, such fuel pumps must be connected mechanically to the drive shaft for the drive shaft to produce the reciprocating movement necessary to drive the piston, thus imposing severe restrictions in terms of location of the fuel pump inside the engine compartment.

cl SUMMARY OF THE INVENTION

It is an object of the present invention to provide an internal combustion engine fuel pump designed to eliminate the aforementioned drawbacks, and which, in particular, is cheap and easy to produce.

According to the present invention, there is provided an internal combustion engine fuel pump, as recited in the accompanying claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
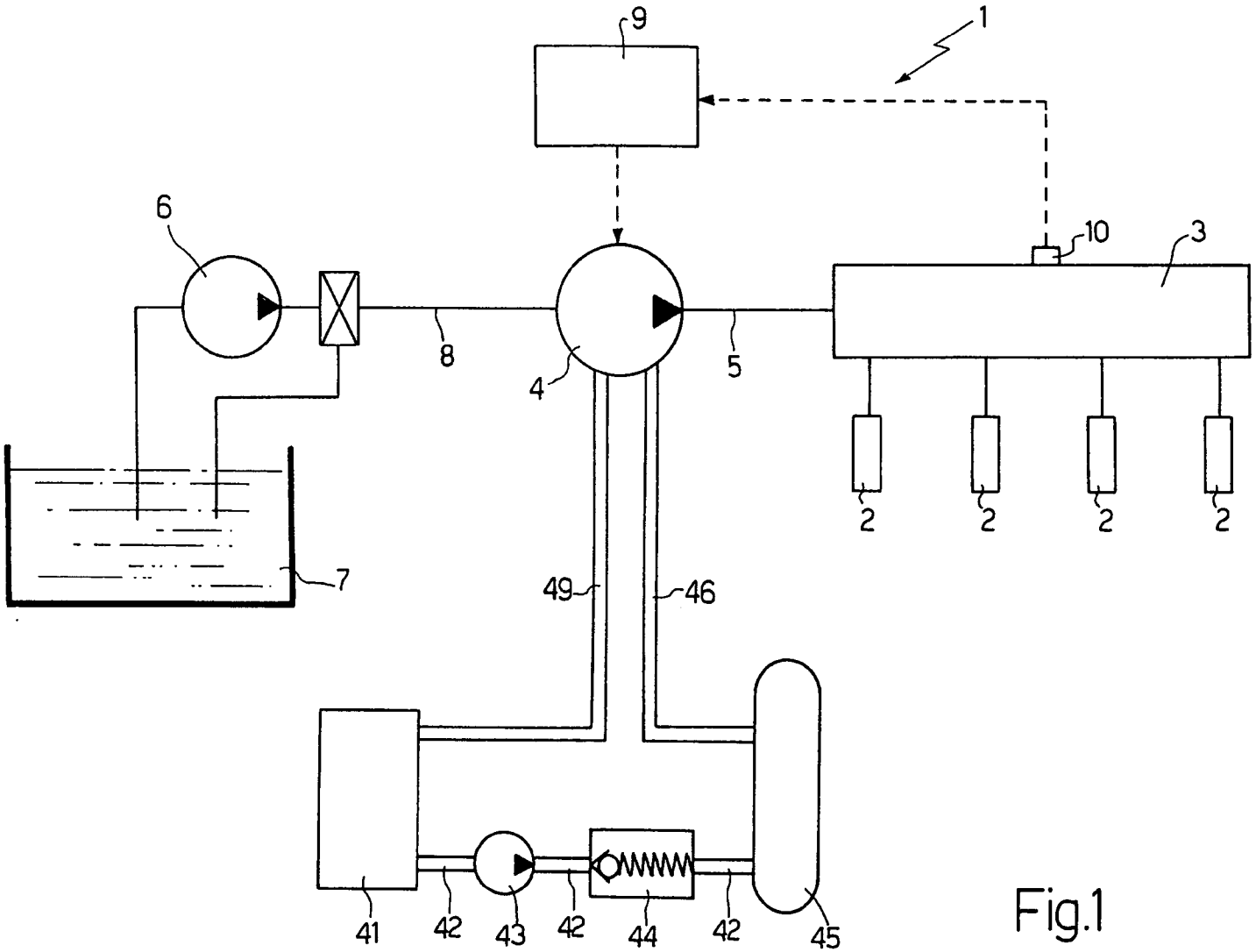
FIG. 1 shows, schematically, a common-rail direct fuel injection system featuring the high-pressure pump according to the present invention.

Number 1 in FIG. 1 indicates as a whole a common-rail system for direct fuel injection into an internal combustion engine having four cylinders (not shown in detail). Injection system 1 comprises four injectors 2, each of which injects fuel directly into the top of a respective cylinder (not shown in detail) of the engine, and is supplied with pressurized fuel by a common rail 3. A high-pressure pump 4 feeds fuel to common rail 3 along a pipe 5, and is supplied with fuel by a low-pressure pump 6, which draws fuel from a tank 7 and is connected to high-pressure pump 4 by a pipe 8.

A control unit 9 regulates the delivery of high-pressure pump 4 to keep the fuel pressure in common rail 3 equal to a desired value, which normally varies as a function of engine operating conditions. Control unit 9 preferably regulates the delivery of high-pressure pump 4 by feedback control, using, as a feedback variable, the real-time fuel pressure value in common rail 3 detected by a sensor 10.

Figure 2:
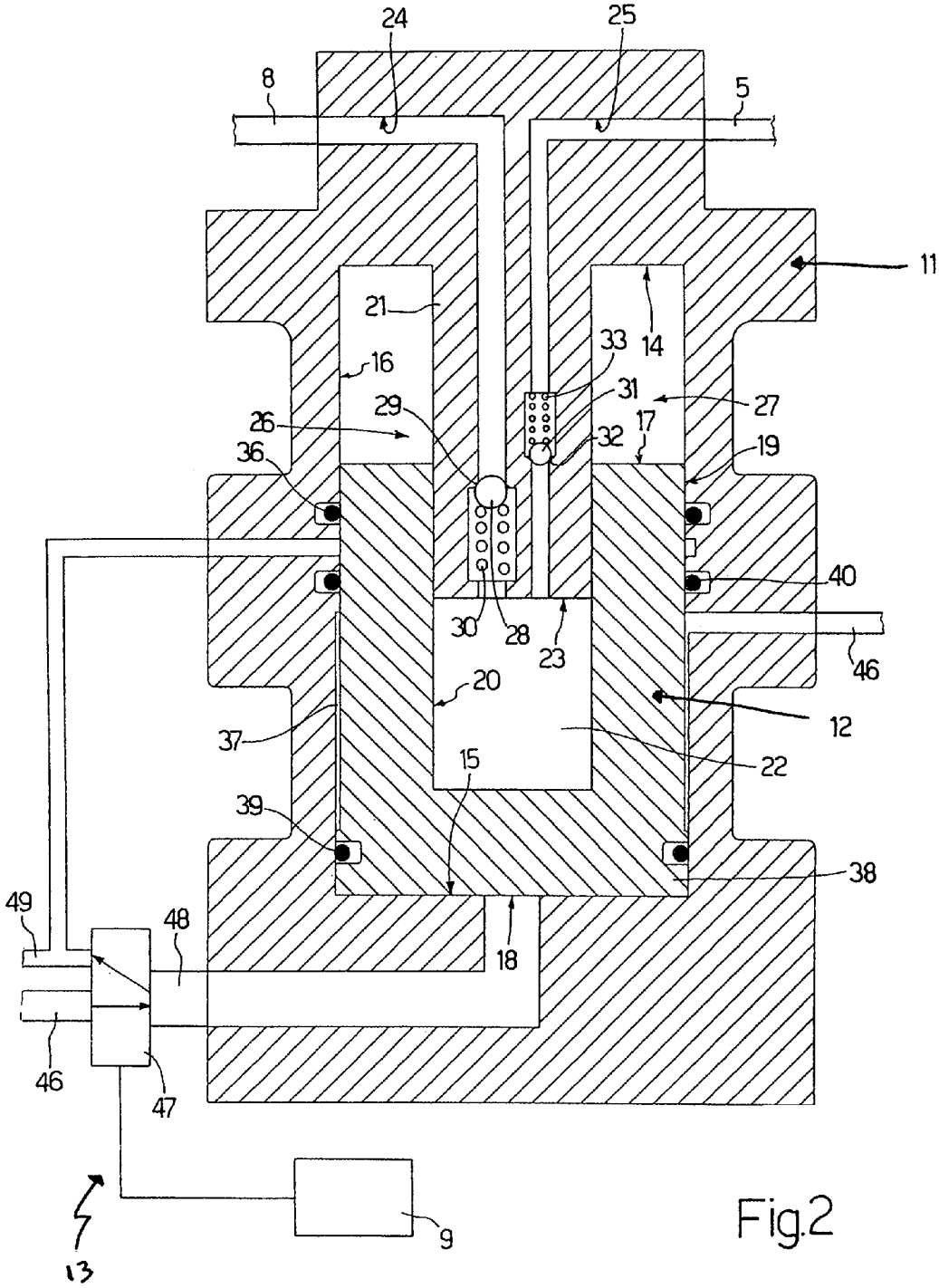
FIGS. 2 and 3 show two schematic lateral sections of two instants in the operation of the FIG. 1 high-pressure pump.
Figure 3:
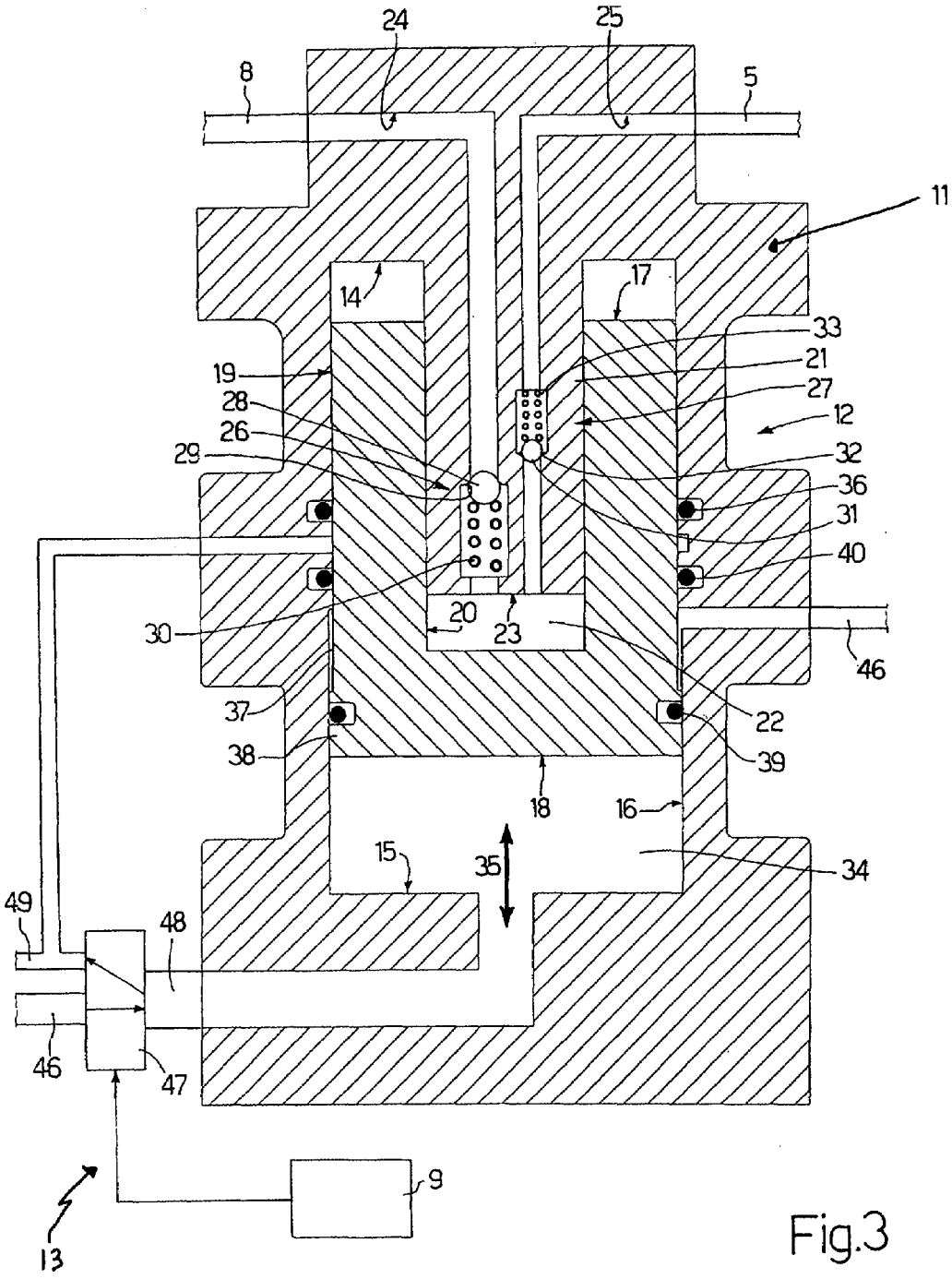

As shown in FIGS. 2 and 3, high-pressure pump 4 comprises two cylinders 11 (only one shown in FIGS. 2 and 3), each of which has a piston 12 moved back and forth inside cylinder 11 by a hydraulic actuating device 13. More specifically, actuating device 13 causes each piston 12 to perform one cycle (i.e. an intake stroke and a pump stroke) for every two rotations of the drive shaft. For every two rotations of the drive shaft, therefore, each cylinder 11 of high-pressure pump 4 performs a compression or pump stroke, and high-pressure pump 4 performs two pump strokes. Operation of each piston 12 is offset 360° with respect to operation of the other piston 12, so that the pump strokes of the two pistons 12 do not overlap, but are distributed symmetrically, so that high-pressure pump 4 performs a compression or pump stroke for each rotation of the drive shaft.

Each cylinder 11 has a top end wall 14, a bottom end wall 15, and a lateral wall 16, and houses in sliding manner respective piston 12, which is cylindrical and has a top end wall 17, a bottom end wall 18, and a lateral wall 19. Top end wall 17 of piston 12 has a cylindrical central hole 20 partly engaged by a cylindrical body 21 extending downwards from top end wall 14 of cylinder 11.

A variable-volume pump chamber 22 is defined inside hole 20 of piston 12, is bounded at the bottom and laterally by the corresponding inner walls of hole 20, and is bounded at the top by an end wall 23 of cylindrical body 21. An intake channel 24, connected to low-pressure pump 6 by pipe 8, and a delivery channel 25, connected to common rail 3 by pipe 5, come out through end wall 23 of cylindrical body 21. Intake channel 24 is regulated by a one-way intake valve 26 only permitting fuel flow into pump chamber 22, and delivery channel 25 is regulated by a one-way delivery valve 27 only permitting fuel flow from pump chamber 22.

Intake valve 26 comprises a valve body 28 movable along intake channel 24; and a valve seat 29, which is engaged in fluidtight manner by valve body 28 and is located at the opposite end of intake channel 24 to that communicating with pump chamber 22. A spring 30 pushes valve body 28 into a position engaging valve seat 29. Intake valve 26 is normally pressure-controlled, in that the forces produced by the difference in pressure on either side of intake valve 26 are greater than the force produced by spring 30. More specifically, intake valve 26 is closed when the fuel pressure in pump chamber 22 is greater than the fuel pressure in pipe 8, and is opened when the fuel pressure in pump chamber 22 is lower than the fuel pressure in pipe 8.

Delivery valve 27 comprises a valve body 31 movable along delivery channel 25; and a valve seat 32, which is engaged in fluidtight manner by valve body 31 and is located at the end of delivery channel 25 communicating with pump chamber 22. A spring 33 pushes valve body 31 into a position engaging valve seat 32. Delivery valve 27 is pressure-controlled, in that the forces produced by the difference in pressure on either side of delivery valve 27 are greater than the force produced by spring 33. More specifically, delivery valve 27 is opened when the fuel pressure in pump chamber 22 is greater than the fuel pressure in pipe 5 (i.e. in common rail 3), and is closed when the fuel pressure in pump chamber 22 is lower than the fuel pressure in pipe 5 (i.e. in common rail 3).

A variable-volume actuating chamber 34 is defined inside cylinder 11, is bounded at the bottom and laterally by bottom end wall 15 and lateral wall 16 of cylinder 11, and is bounded at the top by bottom end wall 18 of piston 12. Depending on the movement of piston 12 inside cylinder 11 in a pumping direction 35, the variation in the volume of actuating chamber 34 is obviously opposite with respect to that of pump chamber 22. That is, when the volume of actuating chamber 34 is minimum (as shown in FIG. 2), the volume of pump chamber 22 is maximum, and vice versa. Lateral wall 16 of cylinder 11 is fitted with a sealing ring 36 (or so-called O-ring and preferably made of polymer material) for fluidtight sealing actuating chamber 34 with respect to pump chamber 22.

A further actuating chamber 37 is defined inside cylinder 11, is located above actuating chamber 34 in pumping direction 35, and is defined between a portion of lateral wall 16 of cylinder 11 and a corresponding portion of lateral wall 19 of piston 12. More specifically, cylinder 11 has a bottom annular recess formed in lateral wall 16 of cylinder 11, bounded at the top by lateral wall 16 of cylinder 11, and bounded at the bottom by an annular expansion 38 of piston 12. Depending on the movement of piston 12 inside cylinder 11 in pumping direction 35, the variation in the volume of actuating chamber 37 is obviously opposite with respect to that of actuating chamber 34. That is, when the volume of actuating chamber 34 is minimum (as shown in FIG. 2), the volume of actuating chamber 37 is maximum, and vice versa. Beneath actuating chamber 37, lateral wall 19 of piston 12 is fitted with a sealing ring 39 (or so-called O-ring and preferably made of polymer material) for fluidtight sealing actuating chamber 37 with respect to actuating chamber 34. Above actuating chamber 37, lateral wall 16 of cylinder 11 is fitted with a sealing ring 40 (or so-called O-ring and preferably made of polymer material) for fluidtight sealing actuating chamber 37 with respect to pump chamber 22.

As shown in FIGS. 1, 2 and 3, actuating device 13 comprises a tank 41 of oil at atmospheric pressure, from which extends a conduit 42 having a pump 43 and a non-return valve 44 for feeding pressurized oil to a hydraulic accumulator 45. Hydraulic accumulator 45 is connected by a conduit 46 to a three-way proportional solenoid valve 47, from which extend a conduit 48, which comes out inside actuating chamber 34, and a conduit 49, which comes out inside tank 41. In actual use, solenoid valve 47 provides for isolating actuating chamber 34, connecting actuating chamber 34 to tank 41, and connecting actuating chamber 34 to hydraulic accumulator 45.

Actuating chamber 37 is connected permanently to hydraulic accumulator 45 by conduit 46. As shown clearly in the accompanying drawings, the total surface area of actuating chamber 37 perpendicular to pumping direction 35 is much smaller than the total surface area of actuating chamber 34 perpendicular to pumping direction 35, so that, when both actuating chambers 34 and 37 are full of pressurized oil, the up-thrust exerted by actuating chamber 34 is much greater than the down-thrust exerted by actuating chamber 37. In a different embodiment not shown, a further three-way proportional solenoid valve is provided to isolate actuating chamber 37, to connect actuating chamber 37 to tank 41, and to connect actuating chamber 37 to hydraulic accumulator 45.

Above actuating chamber 37, an oil recovery opening is provided between sealing ring 36 and sealing ring 40, originates in an annular chamber formed in lateral wall 16 of cylinder 11, and is connected permanently to oil tank 41 by conduit 49.

Operation of one of the two cylinders 11 of high-pressure pump 4 will now be described, as of the start of the downstroke or intake stroke of respective piston 12.

At the start of the downstroke or intake stroke of piston 12, control unit 9 controls solenoid valve 47 to connect actuating chamber 34 to tank 41, so that the oil pressure in actuating chamber 34 falls to substantially atmospheric pressure. At the same time, actuating chamber 37 communicates with hydraulic accumulator 45, and is therefore full of pressurized oil. The thrust exerted by the pressurized oil in actuating chamber 37 is greater than the substantially zero thrust exerted by the oil in actuating chamber 34, so that piston 12 is moved gradually in pumping direction 35 from the top dead-centre position to the bottom dead-centre position. The gradual increase in the volume of pump chamber 22 produces a vacuum in pump chamber 22, thus opening intake valve 6 and filling pump chamber 22 with fuel.

By the time piston 12 reaches the bottom dead-centre position (shown in FIG. 2), the top portion of cylinder 11 is full of fuel, and piston 12 inverts direction and begins its upstroke or compression stroke. For which purpose, control unit 9 controls solenoid valve 47 to connect actuating chamber 34 to hydraulic accumulator 45, so that the pressurized oil flowing into actuating chamber 34 pushes piston 12 up in pumping direction 35. As stated, the total surface area of actuating chamber 37 perpendicular to pumping direction 35 is much smaller than the total surface area of actuating chamber 34 perpendicular to pumping direction 35, so that, when both actuating chambers 34 and 37 are full of pressurized oil, the up-thrust exerted by actuating chamber 34 is much greater than the down-thrust exerted by actuating chamber 37. Intake valve 26 closes upon piston 12 compressing the fuel in pump chamber 22 to a greater pressure than that in pipe 8; and the pressure inside pump chamber 22 continues increasing until it ultimately opens delivery valve 27 to feed pressurized fuel from pump chamber 22 to common rail 3.

On reaching the top dead-centre position, piston 12 ceases to compress the fuel inside pump chamber 22, and the resulting fall in fuel pressure inside pump chamber 22 closes delivery valve 27. At this point, piston 12 begins another downstroke or intake stroke, and the above cycle is repeated.

The pressure at which the fuel in pump chamber 22 is compressed during the up-stroke or compression stroke of piston 12 is obviously substantially equal to the oil pressure inside actuating chamber 34 multiplied by the ratio between the area of bottom end wall 18 of piston 12 and the area of the bottom end wall of pump chamber 22 (the negative contribution of actuating chamber 37 is more or less negligible). For example, with a ⅕ ratio between the area of the bottom wall of pump chamber 22 and the area of bottom wall 18 of piston 12, 1000-bar fuel can be pumped using roughly 210-bar pressurized oil. The extra 10 bars in the oil pressure compensate for the negative contribution of actuating chamber 37 and inevitable load losses.

It should be stressed that the instantaneous delivery of high-pressure pump 4, i.e. the amount of pressurized fuel fed to common rail 3 by each pump stroke, is directly proportional to the variation in the volume of pump chamber 22 during the relative up-stroke or compression stroke. Given the constant area of pump chamber 22, the variation in the volume of pump chamber 22 during the up-stroke or compression stroke is directly proportional to the actual or useful length of the up-stroke or compression stroke. By varying the actual length of the up-stroke or compression stroke of piston 12, the instantaneous delivery of high-pressure pump 4 can therefore be regulated accurately.

The actual length of the up-stroke or compression stroke of piston 12 can be varied easily by appropriately regulating the control timing of solenoid valve 47. That is, to increase the actual length of the up-stroke or compression stroke of piston 12, control unit 9 increases the time interval in which solenoid valve 47 connects actuating chamber 34 to hydraulic accumulator 45, and vice versa.

In a different embodiment not shown, piston 12 has no hole 20, and cylinder 11 has no corresponding body 21, so that intake channel 24 and delivery channel 25 come out at top end wall 14 of cylinder 11, and pump chamber 22 is bounded at the top by top end wall 14 of cylinder 11, is bounded laterally by lateral wall 16 of cylinder 11, and is bounded at the bottom by top end wall 17 of piston 12.

A further embodiment, now shown, has no actuating chamber 37, and the function of exerting return thrust on piston 12 in pump direction 35 and in the opposite direction to the thrust exerted by the pressurized oil in actuating chamber 34, is performed by an elastic member. For example, a spring may be compressed between top end wall 14 of cylinder 11 and top end wall 17 of piston 12; in which case, to compress the fuel in pump chamber 22, the thrust exerted by the pressurized oil inside actuating chamber 34 must also overcome the elastic force of the spring.

In a different embodiment, actuating device 13 is pneumatic as opposed to hydraulic.

High-pressure pump 4 as described above is cheap and easy to produce, in that all its component parts are either easily purchasable (intake valve 26, delivery valve 27, solenoid valve 47, and, generally speaking, the oil circuit as a whole) or cylindrically symmetrical and therefore easy to produce on a lathe. High-pressure pump 4 as described above involves no backflow of fuel through intake valve 26, can be located substantially freely inside the engine compartment, by not being mechanically operated, and permits extremely accurate delivery adjustment. Finally, high-pressure pump 4 as described above also provides for freely controlling fuel delivery timing. That is, instead of a single pump stroke, a number of successive pump strokes may be performed by simply arresting the up-stroke of piston 12 inside cylinder 11 temporarily (by simply controlling solenoid valve 47 to isolate actuating chamber 34 from hydraulic accumulator 45). By controlling the fuel delivery timing of high-pressure pump 4, injectors 2 may all be made to always inject fuel while no fuel is being pumped by piston 12 into common rail 3, or to always inject fuel while piston 12 is pumping fuel into common rail 3. The advantages of this solution are obvious: the fact that injectors 2 always inject fuel while piston 12 of high-pressure pump 4 is or is not pumping fuel provides for simplifying and improving control of injectors 2.

The invention claimed is:

1. A fuel pump (4) for an internal combustion engine, the fuel pump (4) comprising at least one cylinder (11); a variable-volume pump chamber (22) defined inside the cylinder (11);

a piston (12) defining the bottom of the pump chamber (22) and movable with respect to the cylinder (11) in a pumping direction (35);

at least one one-way intake valve (26) only permitting fuel flow into the pump chamber (22);

at least one one-way delivery valve (27) only permitting fuel flow from the pump chamber (22); and an actuating device (13) for moving the piston (12) back and forth with respect to the cylinder (11) and in the pumping direction (35) to cyclically vary the volume of the pump chamber (22);

wherein the actuating device (13) is a fluid-actuated actuating device, which uses the thrust produced by a pressurized control fluid to move the piston (12) back and forth with respect to the cylinder (11) and in the pumping direction (35), and comprises a first actuating chamber (34) located beneath the pump chamber (22) with respect to the pumping direction (35), a control member (47) for connecting the first actuating chamber (34) to a pressurized control fluid tank (45) and to a control fluid drain tank (41), and return means (37) for exerting thrust on the piston (12) in the pumping direction (35) and in the opposite direction to the thrust exerted by the pressurized control fluid in the first actuating chamber (34);

wherein the return means (37) comprise a second actuating chamber (37) located above the first actuating chamber (34) with respect to the pumping direction (35), and which receives pressurized control fluid.

2. A fuel pump (4) as claimed in claim 1, wherein the cylinder (11) is bounded by two end surfaces (14, 15) and by a lateral wall (16), and houses the piston (12) in sliding manner; the piston (12) is cylindrical, and comprises a bottom end wall (18), defining a wall of the first actuating chamber (34), and a lateral wall (19); and the second actuating chamber (37) is an annular chamber, and is defined between the lateral wall (19) of the piston (12) and the lateral wall (16) of the cylinder (11).

3. A fuel pump (4) as claimed in claim 2, wherein the second actuating chamber (37) is defined by an annular recess formed in the lateral wall (16) of the cylinder (11), and is bounded at the bottom, with respect to the pumping direction (35), by an annular expansion (38) of the piston (12).

4. A fuel pump (4) as claimed in claim 2, wherein a first elastic sealing ring (39) is located between the second actuating chamber (37) and the first actuating chamber (34), and two second elastic sealing rings (36, 40) are located between the second actuating chamber (37) and the pump chamber (22).

5. A fuel pump (4) as claimed in claim 4, wherein a recovery opening is formed in the lateral wall (16) of the cylinder (11), is permanently connected to the control fluid drain tank (41), and is located between the two second elastic sealing rings (36, 40).

6. A fuel pump (4) as claimed in claim 1, wherein the actuating device (13) comprises a further control member for connecting the second actuating chamber (37) to the pressurized control fluid tank (45) and to the control fluid drain tank (41).

7. A fuel pump (4) as claimed in claim 1, wherein the second actuating chamber (37) is connected permanently to the pressurized control fluid tank (45), and has a total surface area, perpendicular to the pumping direction (35), smaller than the total surface area, perpendicular to the pumping direction (35), of the first actuating chamber (34).

8. A fuel pump (4) as claimed in claim 1, wherein the cylinder (11) houses the piston (12), and is bounded by two, respectively top and bottom, end surfaces (14, 15) opposite and facing each other; the piston (12) is cylindrical, and comprises a bottom end wall (18), which defines a wall of the first actuating chamber (34), and a top end wall (17)

through which is formed a central hole (20) defining the pump chamber (22); and a cylindrical body (21) extends from the top end wall (14) of the cylinder (11), is inserted inside the central hole (20) of the piston (12), defines a top wall of the pump chamber (22), and houses the delivery valve (27) and the intake valve (26).

9. A fuel pump (4) as claimed in claim 1, wherein a number of elastic sealing rings (36, 39, 40) are provided to isolate the pump chamber (22) from the first actuating chamber (34), and which are made of polymer material.

10. A fuel pump (4) as claimed in claim 1, wherein a control unit (9) varies the amount of fuel to be pumped at each pump stroke by adjusting the useful length of the compression stroke of the piston (12) by regulating the control time of the control member (47).

11. A direct fuel injection system (1) for an internal combustion engine; the system (1) comprises a variable-delivery high-pressure pump (4) as claimed in claim 1, and a common rail (3) supplied by the high-pressure pump (4) and in turn supplying a number of injectors (2); and the high-pressure pump (4) comprises at least one cylinder (11), a variable-volume pump chamber (22) defined inside the cylinder (11), a piston (12) defining the bottom of the pump chamber (22) and movable with respect to the cylinder (11) in a pumping direction (35), at least one intake valve (26) communicating with the pump chamber (22), at least one delivery valve (27) communicating with the pump chamber (22), and a fluid-actuated actuating device (13) for moving the piston (12) back and forth with respect to the cylinder (11) and in the pumping direction (35) to cyclically vary the volume of the pump chamber (22) using the thrust produced by a pressurized control fluid.

12. A fuel pump (4) for an internal combustion engine, the fuel pump (4) comprising at least one cylinder (11); a variable-volume pump chamber (22) defined inside the cylinder (11);

a piston (12) defining the bottom of the pump chamber (22) and movable with respect to the cylinder (11) in a pumping direction (35);

at least one one-way intake valve (26) only permitting fuel flow into the pump chamber (22);

at least one one-way delivery valve (27) only permitting fuel flow from the pump chamber (22); and an actuating device (13) for moving the piston (12) back and forth with respect to the cylinder (11) and in the pumping direction (35) to cyclically vary the volume of the pump chamber (22);

wherein the actuating device (13) is a fluid-actuated actuating device, which uses the thrust produced by a pressurized control fluid to move the piston (12) back and forth with respect to the cylinder (11) and in the pumping direction (35), and comprises a first actuating chamber (34) located beneath the pump chamber (22) with respect to the pumping direction (35), and a control member (47) for connecting the first actuating chamber (34) to a pressurized control fluid tank (45) and to a control fluid drain tank (41);

wherein the cylinder (11) houses the piston (12), and is bounded by two, respectively top and bottom, end surfaces (14, 15) opposite and facing each other; the piston (12) is cylindrical, and comprises a bottom end wall (18), which defines a wall of the first actuating chamber (34), and a top end wall (17) through which is formed a central hole (20) defining the pump chamber (22); and a cylindrical body (21) extends from the top end wall (14) of the cylinder (11), is inserted inside the central hole (20) of the piston (12), defines a top wall of the pump chamber (22), and houses the delivery valve (27) and the intake valve (26).

* * * * *